United States Patent [19]

Uno et al.

[11] 4,112,904

[45] Sep. 12, 1978

[54] ELECTROMAGNETIC TYPE CONTACTLESS IGNITION APPARATUS FOR INTERNAL COMBUSTION ENGINE

[75] Inventors: Eiichi Uno, Toyota; Takasi Hachiga, Kariya, both of Japan

[73] Assignee: Nippondenso Co., Ltd., Kariya, Japan

[21] Appl. No.: 747,870

[22] Filed: Dec. 6, 1976

[30] Foreign Application Priority Data

Dec. 8, 1975 [JP] Japan ..... 50-146616

[51] Int. Cl.[2] ..... F02P 3/04

[52] U.S. Cl. ..... 123/148 E; 315/209 T

[58] Field of Search ..... 123/148 E; 315/209 T

[56] References Cited

U.S. PATENT DOCUMENTS

| | | | |
|---|---|---|---|
| 3,238,416 | 3/1966 | Huntzinger et al. | 315/209 T |
| 3,605,713 | 9/1971 | LeMasters et al. | 123/148 E |
| 3,831,570 | 8/1974 | Compton et al. | 315/209 T |
| 3,882,840 | 5/1975 | Adamian et al. | 123/148 E |
| 4,019,484 | 4/1977 | Mori | 315/209 T |
| 4,030,468 | 6/1977 | Sugiura et al. | 315/209 T |

*Primary Examiner*—Charles J. Myhre
*Assistant Examiner*—Andrew M. Dolinar
*Attorney, Agent, or Firm*—Cushman, Darby & Cushman

[57] ABSTRACT

The output signal induced in an electromagnetic pickup and having a frequency corresponding to the rotational speed of an internal combustion engine is applied to the input of an input transistor. The output of the input transistor is connected to the input of a power transistor having its output connected in series with the primary winding of an ignition coil to turn the power transistor on and off in accordance with the output signal of the electromagnetic pickup and thereby switch on and off the current flowing in the primary winding. A DC bias voltage corresponding to the output signal of the electromagnetic pickup is applied to the input of the input transistor to change its operating level. This change in the operating level changes the ratio between the "on" and "off" periods of the power transistor, namely, the ratio between the "on" and "off" periods of the primary winding of the ignition coil.

1 Claim, 3 Drawing Figures

ELECTROMAGNETIC TYPE CONTACTLESS IGNITION APPARATUS FOR INTERNAL COMBUSTION ENGINE

BACKGROUND OF THE INVENTION

1. Field of the Invention

The present invention relates to an electromagnetic type contactless ignition apparatus for an internal combustion engine of a vehicle or the like.

2. Description of the Prior Art

In a known type of electromagnetic type contactless ignition apparatus, the "on" period for the primary winding of an ignition coil is directly determined in accordance with the output signal of an electromagnetic pickup having a frequency corresponding to the rotational speed of an internal combustion engine. A disadvantage of this conventional apparatus is that at low engine speeds the "on" period of the primary winding becomes excessively long and the heat generation of the ignition coil or the wasted amount of power is increased, while at high engine speeds the "on" period of the primary winding becomes excessively short thus making it impossible to produce satisfactory ignition sparks.

In known apparatus of this type proposed to overcome the foregoing difficulty, as for example disclosed in the specification of U.S. Pat. No. 3,605,713, a resistor is connected in series with the primary winding of an ignition coil and the current flowing in the primary winding is detected in accordance with the voltage developed across the terminals of the resistor, whereby when the detected current is higher than a predetermined value, the bias level of the electromagnetic pickup is changed to control the length of time during which the current flows in the primary winding of the ignition coil.

A disadvantage of this type of apparatus is that not only the construction of the apparatus tends to become complicated due to the fact that the primary winding current is detected by means of the resistor, but also due to the fact that the current detecting resistor is always inserted in the energizing circuit for the primary winding, the resistor generates heat exerting detrimental effect on the various circuits and moreover the power consumption is increased and the amount of secondary voltage is limited.

SUMMARY OF THE INVENTION

With a view to overcoming the foregoing difficulty, it is the object of the present invention to provide an electromagnetic type contactless ignition apparatus for an internal combustion engine wherein the output signal of the signal coil of an electromagnetic pickup which is adapted to produce an output signal corresponding to the rotational speed of the engine, is detected to change the operating level of an input transistor in relation to the output signal waveform of the signal coil and thereby increase the on/off ratio (on time/off time) of a power transistor connected to the input transistor at high engine speeds than at low engine speeds, whereby the "on" period of the primary winding is satisfactorily controlled at low rotational speeds as well high rotational speeds of the engine by means of the simple arrangement in which simply the output signal of the electromagnetic pickup is detected to change the operating level of the input transistor.

DESCRIPTION OF THE PREFERRED EMBODIMENT

The present invention will now be described in greater detail with reference to the illustrated embodiment.

Figure 1:
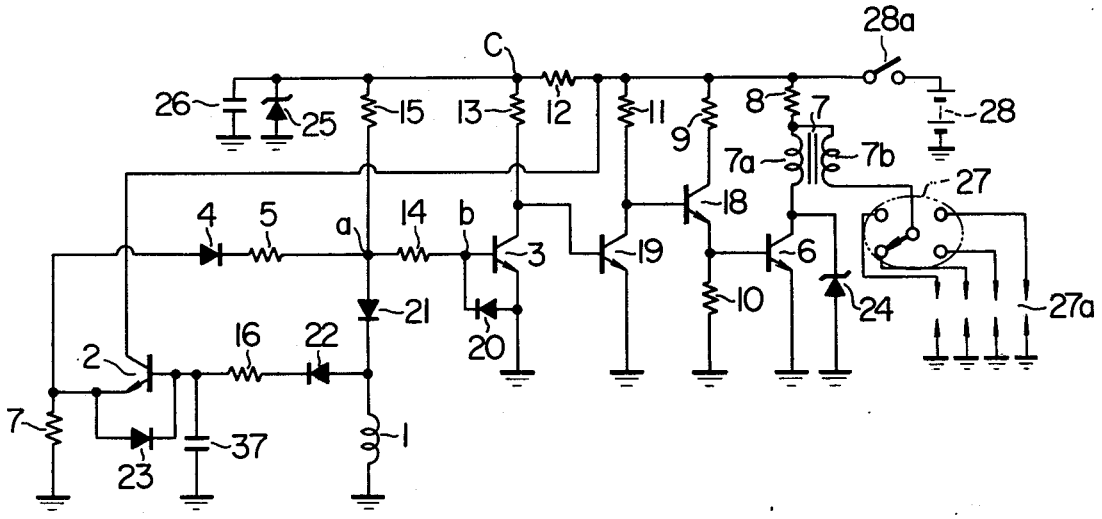
FIG. 1 is a circuit diagram showing an embodiment of an electromagnetic type contactless ignition apparatus according to the present invention.

Referring now to FIG. 1, numeral 1 designates the signal coil of an electromagnetic pickup which produces an output pulse signal voltage whose frequency is varied in accordance with the rotational speed of an internal combustion engine, and the signal coil 1 has its one end grounded and the other end connected to the base of a transistor 2 through a diode 22 and a resistor 16 which are connected in series circuit relation with each other. A diode 23 is connected in inverse parallel relation between the base and emitter of the transistor 2, namely, the diode 23 has its anode and cathode respectively connected to the emitter and base of the transistor 2, and a capacitor 37 is connected between the base of the transistor 2 and the ground. Also connected between the emitter of the transistor 2 and the ground is a resistor 17, and a battery 28 is connected between the collector of the transistor 2 and the ground through an ignition switch 28*a*. It is arranged so that as the peak value of the output voltage of the signal coil 1 increases and as the period of production of the output voltage of the signal coil 1 decreases, the charged voltage of the capacitor 37 is increased and the emitter potential of the transistor 2 rises. The end of the signal coil 1 which is remote from the ground is connected to the cathode of a diode 21 whose anode or a point *a* is connected to a point *b* or the base of an input transistor 3 through a resistor 14. A diode 20 is connected in inverse-parallel relation between the base and emitter of the input transistor 3 whose emitter is grounded. It is designed so that the base potential of the input transistor 3 is changed in accordance with the output voltage of the signal coil 1 to thereby turn on and off the input transistor 3. On the other hand, the emitter of the transistor 2 is connected to the point *a* through a diode 4 and a resistor 5 so that the operating level of the input transistor 3 is changed in accordance with the conductivity of the transistor 2, and an on angle control circuit is formed by the diodes 4, 22 and 23, the resistors 5, 16 and 17, the capacitor 37 and the transistor 2. A Zener diode 25 and a capacitor 26 which are connected in parallel circuit relation with each other, are connected across the terminals of the battery 28 through the ignition switch 28*a* and a resistor 12 so as to maintain substantially constant the voltage at a point *c* on the cathode side of the Zener diode 25 irrespective of variations in the voltage of the battery 28. The point *c* is connected to the point *a* by way of a resistor 15, and the point *c* is also connected to the collector of the input transistor 3 through a resistor 13. The collector of the input transistor 3 is connected to the base of a transistor 19 having its emitter grounded and its collector connected through the resistor 11 and the ignition switch 28a to the end of the battery 28 which is remote from the ground, and the transistor 19 inverts and amplifies the output of the input transistor 3. The collector of the transistor 19 is also connected to the base of a transistor 18 having its emitter grounded through a resistor 10 and its collector connected through a resistor 9 and the ignition switch 28a to the end of the battery 28 which is remote from the ground, and the transistor 18 functions to invert and amplify the output of the transistor 19. The emitter of the transistor 18 is connected to the base of a power transistor 6 having its emitter grounded and its collector connected through a primary winding 7a of an ignition coil 7, a current limiting resistor 8 and the ignition switch 28a to the end of the battery 28 which is remote from the ground, and the power transistor 6 amplifies the output of the transistor 18 and turns on and off the energizing circuit for the primary winding 7a of the ignition coil 7 thus inducing a high voltage in a secondary winding 7b upon rapid interruption of the current flow in the primary winding 7a. Connected between the collector of the power transistor 6 and the ground is a Zener diode 24 for protecting the power transistor 6. A spark plug 27a provided in each cylinder of the engine is connected to the secondary winding 7b of the ignition coil 7 through a distributor 27 so that a high voltage induced in the secondary winding 7b of the ignition coil 7 is sequentially distributed to the spark plugs 27a of the cylinders and an ignition spark is produced at each spark plug 27a.

Figure 2:
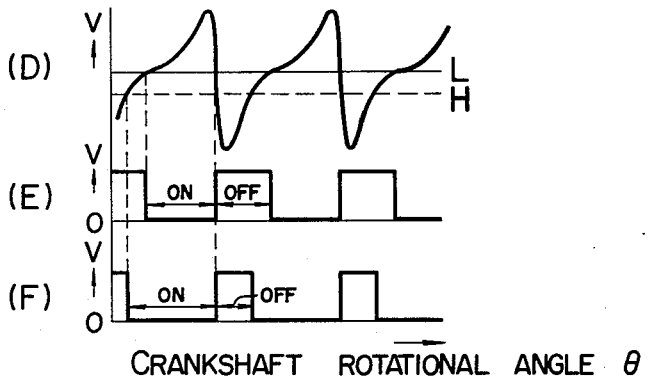
FIG. 2 is a voltage waveform diagram useful in explaining the operation of the embodiment shown in FIG. 1.
Figure 3:
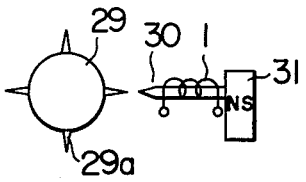
FIG. 3 is a schematic diagram showing an embodiment of the electromagnetic pickup used in the embodiment shown in FIG. 3.

Next, the construction of the electromagnetic pickup will be described with reference to FIG. 3, in which numeral 29 designates an inductor fixedly mounted on the shaft of the distributor 27 shown in FIG. 1 to rotate at one-half engine speed and the inductor 29 is provided with four projections 29a arranged at equal intervals on its outer periphery and corresponding to the number of the engine cylinders with each projection 29a having a sharp forward point. A core 30 having a sharp forward end is placed in a position on the fixed part so that the core 30 is opposed to each of the projections 29a when the inductor 29 is rotated, and the signal coil 1 is wound on the core 30. A permanent magnet 31 is fixedly attached to the end of the core 30 which is remote from the inductor 29 so that the magnetic flux of the permanent magnet 31 flows through the core 30 and the inductor 29 and the flux linking the signal coil 1 is changed by the rotation of the projections 29a caused by the rotation of the inductor 29, thus producing an AC signal voltage in the signal coil 1. In this case, since the forward ends of the opposed projection 29a and core 30 are pointed, a distorted output signal voltage is produced in the signal coil 1 and its waveform is such that one of the polarity changing portions is changed rapidly as shown in (D) of FIG. 2. In FIG. 2, the abscissa represents the crankshaft rotational angle $\theta$ and the ordinate represents the voltage V.

With the construction described above, the operation of the apparatus of this invention will now be described. During low speed operation of the engine, the rotational speed of the inductor 29 of the electromagnetic pickup is low and the rate of change of the flux of the permanent magnet 31 linking the signal coil 1 is also low. Thus, the peak value of the output voltage produced in the signal coil 1 is low and the charged voltage of the capacitor 37 is low. The period of production of the output voltage is also long and the discharge time of the capacitor 37 is long. Consequently, the voltage across the capacitor 37 is relatively low and the emitter potential of the transistor 2 is low. Thus, since this emitter potential of the transistor 2 is applied to the base of the input transistor 3 through the diode 4 and the resistors 5 and 14, the resulting base potential of the input transistor 3 is relatively low and the operating level of the input transistor 3 in relation to the output waveform of the signal coil 1 has a relatively high value as shown by a solid line L in (D) of FIG. 2. Consequently, when the output voltage of the signal coil 1 is higher than the operating level shown by the solid line L in FIG. 2, the input transistor 3 is turned on, the transistor 19 is turned off, the transistor 18 is turned on and the power transistor 6 is turned on, thus causing current to flow from the battery 28 into the primary winding 7a of the ignition coil 7 through the ignition switch 28a and the resistor 8. On the other hand, when the output voltage of the signal coil 1 becomes lower than the operating level shown by the solid line L in FIG. 2, the input transistor 3 is turned off, the transistor 19 is turned on, the transistor 18 is turned off and the power transistor 6 is turned off, with the result that the current flow in the primary winding 7a of the ignition coil 7 is interrupted and a high voltage is produced in the secondary winding 7b of the ignition coil 7 upon the interruption, thus producing an ignition spark at the proper spark plug 27a through the distributor 27. Thus, the resulting output or collector voltage produced by the turning on and off of the input transistor 3 and the power transistor 6 becomes as shown in (E) of FIG. 2.

On the other hand, as the engine rotational speed increases, the rotational speed of the inductor 29 of the electromagnetic pickup increases and the rate of change of the flux of the permanent magnet 31 linking the signal coil 1 also increases. Consequently, the peak value of the output voltage of the signal coil 1 increases and the period of production of the output voltage decreases, thus causing the voltage across the capacitor 37 and the emitter potential of the transistor 2 to increase as the rotational speed of the engine increases. This emitter potential of the transistor 2 is applied to the base of the input transistor 3 through the diode 4 and the resistors 5 and 14, with the result that the base potential of the input transistor 3 rises as the engine rotational speed increases and the operating level of the input transistor 3 in relation to the output waveform of the signal coil 1 decreases with increase in the rotational speed of the engine as shown by a dotted line H in (D) of FIG. 2, for example. The reason is that since the voltage at the point *a* in FIG. 1 becomes high as compared with that at the low engine rotational speeds, the input transistor 3 is cut off when the terminal voltage of the signal coil 1 decreases further as compared with that obtained at the low rotational speeds of the engine. Consequently, the output or collector voltage produced by the turning on and off of the input transistor 3 and the power transistor 6 becomes as shown in (F) of FIG. 2, for example, with the result that the on/off ratio (on period/off period) of the power transistor 6 increases with increase in the engine rotational speed and the energized or "on" period of the primary winding 7a of the ignition coil 7 during the high speed operation of the engine is increased sufficiently. Namely, in this embodiment, the minimum value for the on/off ratio (on period/off period) of the primary winding 7a of the ignition coil 7 at low engine rotational speeds is preset to a value sufficient for causing the current flowing in the primary winding 7a of the ignition coil 7 to saturate and in this way the generation of heat and the waste of power by the ignition coil 7 at low engine rotational speeds are prevented and the on/off ratio (on period/off period) of the primary winding 7*a* of the ignition coil 7 is increased with increase in the rotational speed of the engine thus supplying current to the primary winding 7*a* of the ignition coil 7 for a sufficient period of time even at high engine speeds. While, in this embodiment, the emitter potential of the transistor 2 decreases to the lowest value when the engine is stopped under overload condition or the like with the ignition switch 28*a* being turned on, the operating level of the input transistor 3 may be preset higher than the zero potential point for the output voltage of the signal coil 1, so that when the engine is stopped, the input transistor 3 and the power transistor 6 are always turned off and the current flow in the primary winding 7*a* of the ignition coil 7 is always stopped, thus preventing the generation of heat and the waste of power by the ignition coil 7 when the engine is stopped with the ignition switch 28*a* being closed.

Further, while, in the above-described embodiment, the "on" and "off" operations of the input transistor 3 and the power transistor 6 are effected in the same phase relation and the on/off ratio (on period/off period) of the power transistor 6 is increased more at high engine rotational speeds than at low engine rotational speeds by the on angle control circuit by which the operating level of the input transistor 3 in relation to the output signal of the signal coil 1 is decreased as the rotational speed of the engine increases, it may be arranged so that the "on" and "off" operation of the input transistor 3 and the power transistor 6 are effected in the opposite phase relation by for example additionally providing an inverter circuit, the output signal waveform of the signal coil 1 is inverted by for example changing the connection of the signal coil 1 and the on/off ratio (on period/off period) of the power transistor 6 is increased more at high engine speeds than at low engine speeds through an on angle control circuit by which the operating level of the input transistor 3 in relation to the output signal of the signal coil 1 is increased with increase in the rotational speed of the engine.

Still further, while, in the above-described embodiment, the on angle control circuit detects both the peak value and period of the output signal voltage of the signal coil 1 to change the operating level of the input transistor 3, the on angle control circuit may be constructed so that only the period or peak value of the output signal voltage of the signal coil 1 is detected to change the operating level of the input transistor 3. Further, in FIG. 1, the diode 22 may be replaced with a Zener diode having its cathode connected to the signal coil 1 and its anode connected to the resistor 16. Still further, the construction of electromagnetic pickup needs not be limited to the one shown in FIG. 3 and an electromagnetic pickup of any other construction may be used. In this case, if the ignition timing is changed at an unsuitable instance by the output signal waveform of the signal coil 1 of the electromagnetic pickup due to a change in the rotational speed of the engine, this drawback may be overcome by causing the centrifugal spark advance mechanism of the distributor 27 to provide compensation for changes in the ignition timing caused by the output signal waveform of the signal coil 1.

Still further, in the embodiment shown in FIG. 1, a similar effect may be obtained by connecting the end of the resistor 5 to the point *b* instead of connecting it to the point *a*.

What is claimed is:

1. An electromagnetic type contact ignition apparatus for an internal combustion engine of the type including a battery, and an ignition coil having a primary coil and a secondary coil connected with spark plugs;

said ignition apparatus comprising:

timing means for generating an output signal in timed relationship with the engine, said timing means including a pickup coil whose one end is grounded and a diode with its cathode connected with the other end of said pickup coil;

an input transistor having a base connected with the anode of the diode of said timing means to be conductive and non-conductive in response to the output signal of said timing means;

switching means connected in series with said battery and the primary coil of said ignition coil said switching means responsive to said input transistor for charging and discharging said ignition coil with an electric energy in response to the output of said timing means; and operating level control means connected with said input transistor in parallel with said timing means for applying to said input transistor a DC bias voltage which increases as the rotational speed of said engine increases, last said means including a control transistor having an emitter-collector path connected with said battery, a capacitor charging circuit, a capacitor discharging circuit and an operating level supplying diode with its cathode connected through a resistor with said input transistor, said capacitor charging circuit including a diode with its anode connected with said other end of said pickup coil, a resistor and a capacitor with its one end being grounded, said capacitor discharging circuit including said capacitor, the base-emitter path of said control transistor and a resistor with its one end being grounded with its other end being connected with the anode of said operating level supplying diode.

* * * * *